US010940522B2

(12) United States Patent
Enoki et al.

(10) Patent No.: US 10,940,522 B2
(45) Date of Patent: Mar. 9, 2021

(54) BOTTLE-SHAPED CAN WITH CAP

(71) Applicant: DAIWA CAN COMPANY, Chiyoda-ku (JP)

(72) Inventors: Yasushi Enoki, Sagamihara (JP); Osamu Yoshida, Sagamihara (JP)

(73) Assignee: DAIWA CAN COMPANY, Chiyoda-ku (JP)

( * ) Notice: Subject to any disclaimer, the term of this patent is extended or adjusted under 35 U.S.C. 154(b) by 57 days.

(21) Appl. No.: 16/372,537

(22) Filed: Apr. 2, 2019

(65) Prior Publication Data

US 2019/0299273 A1 Oct. 3, 2019

(30) Foreign Application Priority Data

Apr. 3, 2018 (JP) ..... JP2018-071747

(51) Int. Cl.
*B21D 51/40* (2006.01)
*B21D 51/50* (2006.01)
*B65D 1/02* (2006.01)

(52) U.S. Cl.
CPC ..... *B21D 51/40* (2013.01); *B21D 51/50* (2013.01); *B65D 1/0246* (2013.01)

(58) Field of Classification Search
CPC ..... B21D 51/42; B21D 51/40; B21D 51/50; B21D 51/44; B65D 1/0246; B65D 1/023; B65D 11/08; B65D 50/063; B65D 41/348; B65D 41/34; B65D 41/3409; B65D 41/3428
USPC .... 215/252, 253, 250, 44, 43; 220/601, 276, 220/266, 265; 72/379.4
See application file for complete search history.

(56) References Cited

U.S. PATENT DOCUMENTS 3,559,833 A * 2/1971 Alonso ..... B65D 1/0246 215/44
4,813,561 A * 3/1989 Ochs ..... B65D 41/3409 215/252
5,704,240 A * 1/1998 Jordan ..... B21D 15/04 72/103
6,959,830 B1 * 11/2005 Kanou ..... B65D 1/0223 215/40

(Continued)

FOREIGN PATENT DOCUMENTS

JP 2744243 4/1998
JP 4025535 12/2007
JP 4667854 4/2011

*Primary Examiner* — Robert J Hicks
(74) *Attorney, Agent, or Firm* — Oblon, McClelland, Maier & Neustadt, L.L.P.

(57) ABSTRACT

A bottle-shaped can in which a cap can be mounted on a neck portion without damaging slits and bridges. An annular bead comprises a diametrically largest portion, an upper inclined surface, and a lower inclined surface. An angle of inclination of the upper inclined surface is narrower than that of the lower inclined surface. A thread ridge comprises an incomplete thread portion in which a groove depth is shallower than an average groove depth of the thread ridge, and the incomplete thread portion is formed at one end of the thread ridge on the upper inclined surface at least partially. An angle of inclination of a lower wall of the thread ridge is greater than that of the upper inclined surface so that a protruding corner is formed. The slits and the bridges are situated at a level lower than the protruding corner.

8 Claims, 8 Drawing Sheets

(56) References Cited

U.S. PATENT DOCUMENTS

| | | | | |
|---|---|---|---|---|
| 8,016,148 | B2 * | 9/2011 | Walsh | B65D 1/0207 220/288 |
| 9,511,905 | B2 * | 12/2016 | Tsujiguchi | B65D 1/0246 |
| 2009/0211329 | A1 | 8/2009 | Hanafusa et al. | |
| 2016/0340088 | A1 * | 11/2016 | Olson | B65D 1/0246 |
| 2019/0291913 | A1 * | 9/2019 | Enoki | B21D 51/2669 |
| 2020/0223596 | A1 * | 7/2020 | Fink | B65D 41/17 |

* cited by examiner 26e
26d
26c
26b
26a
3
(25)
26d
7
26a
3
6
O
θ
6
7
10
9
8
3
7
h
7a
ha

BOTTLE-SHAPED CAN WITH CAP

The present invention claims the benefit of Japanese Patent Application No. 2018-071747 filed on Apr. 3, 2018 with the Japanese Patent Office, the disclosure of which is incorporated herein by reference in its entirety.

BACKGROUND

Field of the Invention

The present disclosure relates generally to a bottle-shaped can that is resealable by a cap, and more specifically, to a bottle-shaped can in which a cap having a pilfer-proof band is screwed onto a neck portion of a can body.

Discussion of the Related Art

In the bottle-shaped can, the cap is mounted on the neck portion by a so-called "roll-on capping" method. An opening edge (i.e., an upper edge) of the neck portion is curled outwardly. A helical thread groove (or ridge) is formed below the curled portion, and an annular bead is formed below the helical thread. A raw material of the cap mounted on the neck portion is processed to conform to configurations of the curled portion, the thread portion, and the annular bead. The raw material of the cap comprises a top panel, and a cylindrical skirt portion extending downwardly from the top panel. A sealing liner is affixed to an inner surface of the top panel to be brought into close contact to the curled portion. In the cap, the helical thread is formed on an upper major portion of the skirt potion, and horizontal slits and bridges are formed alternately in a circumferential direction on a lower portion of the skirt portion so that a pilfer-proof band is formed on a lower end of the skirt portion of the cap. When the cap mounted on the neck portion is twisted to open the can, the bridges of the skirt portion are raptured so that the pilfer-proof band is detached from the skirt portion.

The bridge portions have to be broken easily when dismounting the cap, but it is necessary to mount the raw material of the cap on the neck portion without breaking and deforming the bridges. An example of a technique to prevent such breakage of the bridges when capping the bottle-shaped can is described in Japanese Patent No. 4025535. According to the teachings of Japanese Patent No. 4025535, a thread is formed prior to swaging the pilfer-proof band. According to the teachings of Japanese Patent No. 4025535, therefore, a drawing amount of the pilfer-proof band can be reduced so that a tension applied to the bridges is relaxed.

A stress to break the bridges when swaging the pilfer-proof band onto the annular bead of the neck portion is governed by dimensions of the annular bead and an angle of an inclined surface. For this reason, according to the method described in Japanese Patent No. 2744243, the lower inclined surface of the skirt portion (or the annular bead) is reformed simultaneously with or after forming the curled portion on the neck portion. Further, Japanese Patent No. 4667854 describes a method for forming a helical thread on a cap in which a recessed portion is formed on a skirt portion continuously or intermittently in the circumferential direction to adjust a configuration of an annular bead of a neck portion. An angle of an inclined surface below the annular bead to be covered by the pilfer-proof band is changed depending on a distance between the thread and the annular bead. For example, given that the distance between the thread and the annular bead is too long, an inclination of the inclined surface below the annular bead is reduced. In order to prevent such reduction in the inclination of the inclined surface, according to the teachings of Japanese Patent No. 4667854, the recessed portion is formed on the skirt portion by depressing the skirt portion radially inwardly.

In the conventional art, a cap is mounted on the neck portion (or a container mouth) of the bottle-shaped can by the roll-on capping method. Specifically, a thread groove is formed on the cylindrical skirt portion of the cap by pressing the skirt portion by a thread roller onto the skirt portion from radially outer side while revolving the thread roller around the skirt portion along a thread ridge formed on the neck portion of a can body. Thus, the thread ridge formed on the neck portion serves as a guide groove for the thread roller. The thread roller is supported while being allowed to roll along the thread ridge of the neck portion and to move radially inwardly toward a center axis of the neck portion. That is, if the thread ridge is formed incorrectly to have some kind of defect, the thread roller is not allowed to move properly, and consequently the bridges connecting the pilfer-proof band to the skirt portion will be broken accidentally and slits formed alternately with the bridges will not be formed properly.

For example, as illustrated in FIG. 10, a malfunction of the thread ridge may be caused by a defect of an incomplete thread portion at a lower end of the thread groove. An annular bead 50 comprises a diametrically largest portion 51, an upper inclined surface 52, and a lower inclined surface 53. In the example shown in FIG. 10, a taper angle of the upper inclined surface 52 is smaller than a taper angle of the lower inclined surface 53. An annular bead 50 is also called as a stepped portion.

A cross-sectional shape of a thread groove of an effective thread portion 55 of a thread 54 along a plane passing through a center axis of a neck portion 56 is symmetrical in a vertical direction across a center of the thread groove. On the other hand, a lower incomplete thread portion 57 extending from the effective thread portion 55 reaches the upper inclined surface 52. That is, the lower incomplete thread portion 57 is formed on a part of the annular bead 50. A groove depth of the incomplete thread portion 57 is shallower than a groove depth of the effective thread portion 55. In the thread 54, therefore, a lower surface of the thread groove of the incomplete thread portion 57 is connected to the upper inclined surface 52 to serve as a part of the upper inclined surface 52. That is, a cross-sectional shape of the thread groove of the incomplete thread portion 57 is asymmetrical across the center of the thread groove in the vertical direction.

In order to form the thread groove on the skirt portion of the cap, a cross-sectional shape of a thread roller 60 is also symmetrical in a thickness direction as the cross-sectional shape of the effective thread portion 55. In the example shown in FIG. 10, therefore, a helical thread groove can be formed symmetrically on an upper portion of a skirt portion 62 of a cap material 61 by pushing the skirt portion 62 into the effective thread portion 55 by the thread roller 60. However, the thread groove is also formed on a lower portion of the skirt portion 62 by pushing the skirt portion 62 into the asymmetrical incomplete thread portion 57 using the thread roller 60 having the symmetrical cross-section. That is, since the thread groove of the incomplete thread portion 57 is asymmetrical, a space is maintained inside of the skirt portion 62 when the skirt portion 62 is pushed by the thread roller 60 on the incomplete thread portion 57. As a result, a stress on a portion of the skirt portion 62 above slits 63 is increased thereby turning the portion of the skirt portion 62 outwardly upwardly.

In addition, in the incomplete thread portion 57, a reaction force in the vertical direction in FIG. 10 against the thread roller 60 is imbalanced. As described, the thread roller 60 has a certain degree of freedom to move. Therefore, if the reaction force against the thread roller 60 is imbalanced, the thread roller 60 may be deviated accidentally from the thread groove by an unexpected external force or resistance. Specifically, in the example shown in FIG. 10, the reaction force against the thread roller 60 from the lower side is reduced and an orbit of the thread roller 60 will be deviated downwardly. As a result, the thread roller may interfere with the slits 63 to deform the slits 63, and bridges (not shown) formed between the slits 63 may be broken.

Thus, the breakage of the bridges and turning or curling of the lower portion of the skirt portion above the slits may be caused not only by a reduction in accuracy of dimension of the annular bead but also by an inconsistency of shapes of the thread roller and the thread groove of the neck portion. However, although the above-mentioned prior art documents describe about an order of forming the annular bead and a configuration or dimension of the annular bead, those prior art documents are silent about a technical problem and a solution relating to the thread roller and the thread groove. In addition, although a cross-sectional shape of the thread groove and configuration of the skirt portion around the neck portion are shown in the above-mentioned prior art documents, those prior art documents are also silent about a relation between the thread groove of the lower incomplete thread portion or the lower wall of the incomplete thread portion and the upper inclined surface of the annular bead.

SUMMARY OF THE INVENTION

The present disclosure has been conceived nothing the foregoing technical problems, and it is therefore an object of the present disclosure to provide a bottle-shaped can in which a cap is mounted on a neck portion of a can body without damaging skirt portion of the cap and bridges connecting a pilfer-proof band the skirt portion.

The bottle-shaped can with a cap according to the exemplary embodiment of the present disclosure comprises: a neck portion in which an upper end portion is opened; and a cap that is mounted on the neck portion to close the upper end portion of the neck portion. In the bottle-shaped can, a thread ridge is formed on the neck portion to engage the cap with the neck portion, and an annular bead is formed on the neck portion below the thread ridge. The cap comprises a band portion formed around the annular bead to be engaged with the annular bead, and a plurality of slits and bridges formed alternately in a circumferential direction of the cap. The band portion is detached from the cap by rupturing the bridges. In order to achieve the above-explained objective, according to the exemplary embodiment of the present disclosure, the annular bead comprises: a diametrically largest portion; an upper inclined surface extending upwardly from the diametrically largest portion in which an outer diameter of the neck portion gradually decreases; and a lower inclined surface extending downwardly from the diametrically largest portion in which the outer diameter of the neck portion gradually decreases. An angle of inclination of the upper inclined surface with respect to a center axis of the neck portion is narrower than an angle of inclination of the lower inclined surface with respect to the center axis of the neck portion. The thread ridge comprises an incomplete thread portion in which a groove depth is shallower than an average groove depth of the thread ridge. The incomplete thread portion is formed at one end of the thread ridge on the upper inclined surface of the annular bead at least partially. An angle of inclination of a lower wall of a groove of the thread ridge with respect to the center axis is greater than the angle of inclination of the upper inclined surface with respect to the center axis so that a protruding corner is formed between the lower wall and the upper inclined surface to protrude radially outwardly. The slits and the bridges are situated at a level lower than the protruding corner in the cap mounted on the neck portion.

In a non-limiting embodiment, a length of the incomplete thread portion in the circumferential direction of the neck portion may be defined by an angle between: a line drawn between a terminal end of the incomplete thread portion and a center point of the neck portion; and a line drawn between a starting point of the incomplete thread portion. Specifically, the length of the incomplete thread portion in the circumferential direction of the neck portion may be set such that said angle is 50 degrees or wider.

In a non-limiting embodiment, an outer diameter of the protruding corner may be smaller than a maximum diameter of the annular bead but larger than an outer diameter of a bottom of the groove of the incomplete thread portion.

In a non-limiting embodiment, the outer diameter of the protruding corner may be smaller than the maximum diameter of the annular bead but larger than an outer diameter of the thread ridge.

Thus, in the bottle-shaped can with the cap according to the exemplary embodiment of the present disclosure, the thread ridge is formed on the neck portion, and the annular bead is formed below the thread ridge. The lower incomplete thread portion of the thread ridge is formed on the upper inclined surface of the annular bead at least partially. The protruding corner is a boundary between the lower wall of the incomplete thread portion and the upper inclined surface of the upper inclined surface. As described, the angle of inclination of the lower wall of the groove of the thread ridge with respect to the center axis is greater than the angle of inclination of the upper inclined surface with respect to the center axis so that the protruding corner is formed between the lower wall and the upper inclined surface. Since the angle of inclination of the lower wall is greater than that of the upper inclined surface, the thread groove can be formed sharply underneath the incomplete thread portion by the lower wall of the incomplete thread portion and the annular bead. Therefore, a thread groove can be formed properly on the skirt of the cap by pressing the skirt by a thread roller into the groove between the thread ridge of the neck portion. That is, a portion of the skirt opposed to the lower wall of the incomplete thread portion will not be pressed excessively inwardly during execution of a roll-on capping. For this reason, a stress to turn or curl a lower portion of the skirt outwardly can be reduced to prevent rupture of the bridges during execution of the roll-on capping. In addition, since the angle of inclination of the lower wall is greater than that of the upper inclined surface, reaction forces can be applied to the thread roller in the thread groove equally from both sides. For this reason, the thread roller is allowed to form the thread groove on the skirt of the cap without causing an interference with the slits and the bridges. In other words, the thread groove may be formed on the skirt of the cap without curling the lower portion of the skirt and without rupturing the bridges.

As described, according to the exemplary embodiment of the present disclosure, the length of the incomplete thread portion in the circumferential direction of the neck portion is set in such a manner that a center angle of the neck portion becomes 50 degrees or wider. Therefore, metallic material may be from a broad area when forming the incomplete thread portion. That is, the metallic material will not be drawn locally from the annular bead side where the material of the cap is not held firmly. For this reason, the lower wall of the incomplete thread portion can be formed certainly.

BRIEF DESCRIPTION OF THE DRAWINGS

Features, aspects, and advantages of exemplary embodiments of the present invention will become better understood with reference to the following description and accompanying drawings, which should not limit the invention in any way.

FIGS. 6A, 6B and 6C are partial front views showing a neck portion of the bottle-shaped can, in which FIG. 6A shows the neck portion on which the diametrically-smaller cylindrical portion has been formed, FIG. 6B shows the neck portion on which a thread has been formed, and FIG. 6C shows the neck portion on which an annular bead has been formed;

DETAILED DESCRIPTION OF THE PREFERRED EMBODIMENT(S)

Figure 1:
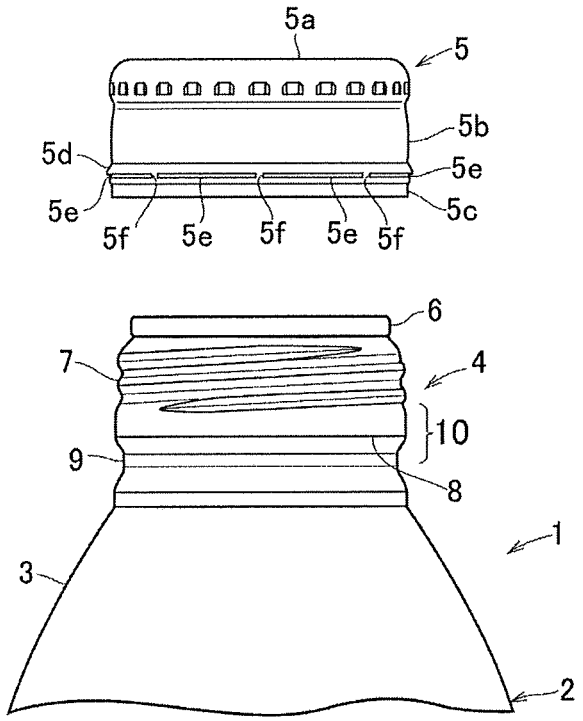
FIG. 1 is a partial front view showing a neck portion of a bottle-shaped can to which the present disclosure is applied.
Figure 2:
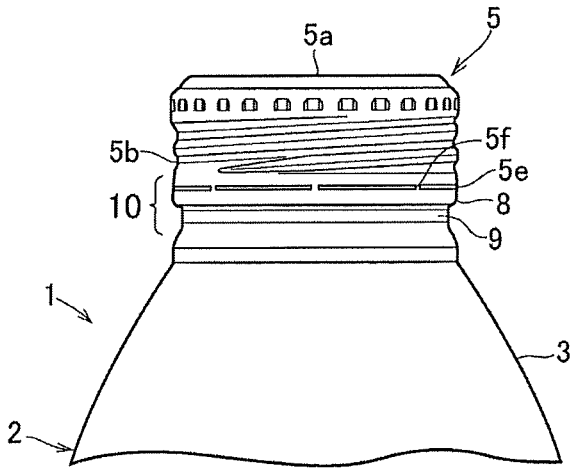
FIG. 2 is a partial front view showing the neck portion of the bottle-shaped can on which a cap is mounted.

Hereinafter, an exemplary embodiment of the present disclosure will be explained in more detail with reference to the accompanying drawings. Referring now to FIGS. 1 and 2, there is shown a bottle-shaped can 1 formed of a metallic sheet such as an aluminum sheet or a resin-coated aluminum sheet. The bottle-shaped can 1 comprises a can trunk 2 as a can body, a shoulder portion 3 formed continuously from the can trunk 2 whose inner diameter is reduced gradually, and a diametrically smaller cylindrical neck portion 4 formed continuously from the shoulder portion 3. A bottom lid (not shown) is seamed to a bottom of the can body to close the bottom of the can body. Instead, a circular bottom formed as a result of forming the can trunk 2 by drawing and ironing a disc-shaped metallic material may also serve as a bottom of the can body. In this case, a diameter of an opening end of the can trunk 2 is reduced gradually to form the shoulder portion 3 and the neck portion 4.

The neck portion 4 has an opening on its leading end portion. In order to use the opening of the neck portion 4 as a container mouth, a curled portion 6 having a round or an oval cross-section is formed on the opening by folding or curling an opening edge of the neck portion 4 outwardly into two or three layers. The opening of the neck portion 4 is closed by a resealable cap 5 mounted on the neck portion 4. A thread ridge 7 is formed on the neck portion 4, and the cap 5 is mounted on the neck portion 4 through the thread ridge 7.

A material of the cap 5 mounted on the neck portion 4 comprises a top panel 5*a* and a cylindrical skirt portion 5*b*, and an elastic resin sealing liner is affixed to an inner surface of the top panel 5*a*. A circumferential corner of the top panel 5*a* is swaged to bring the sealing liner into close contact to the curled portion 6 thereby sealing the opening edge of the neck portion 4, and a thread groove is formed on the skirt portion 5*b* by pressing the skirt portion 5*b* by a thread roller (not shown) along the thread ridge 7 of the neck portion 4.

The cap 5 further comprises a pilfer-proof band 5*c* formed on a lower end of the skirt portion 5*b*. Specifically, an annular bead 5*d* is formed on the skirt portion 5*b* above the pilfer-proof band 5*c*, and horizontal slits 5*e* and bridges 5*f* are formed alternately in a circumferential direction on the annular bead 5*d* at an intermediate level (in the vertical direction) of the annular bead 5*d* so that the pilfer-proof band 5*c* is formed on the lower end of the skirt portion 5*b*. According to the exemplary embodiment, specifically, eight slits 5*e* and eight bridges 5*f* are formed alternately on the annular bead 5*d*.

In the neck portion 4, an annular emboss bead 8 is formed below the thread ridge 7. When the cap 5 mounted on the neck portion 4 is twisted to open the bottle-shaped can 1, the pilfer-proof band 5*c* is engaged with the emboss bead 8 so that the bridges 5*f* are ruptured and the pilfer-proof band 5*c* is detached from the lower end portion of the skirt portion 5*b*. The pilfer-proof band 5*c* thus detached from the skirt portion 5*b* of the cap 5 is retained in an annular groove 9 formed below the emboss bead 8. In the following explanation, the emboss bead 8 and the annular groove 9 of the neck portion 4 will also be called the "stepped portion" 10.

Figure 3:
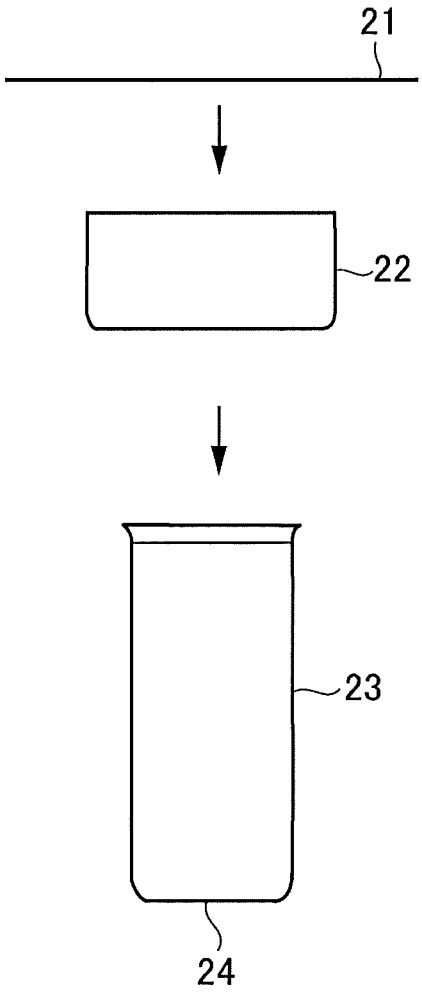
FIG. 3 is a schematic illustration showing a process of forming a trunk portion of the bottle-shaped can.
Figure 4:
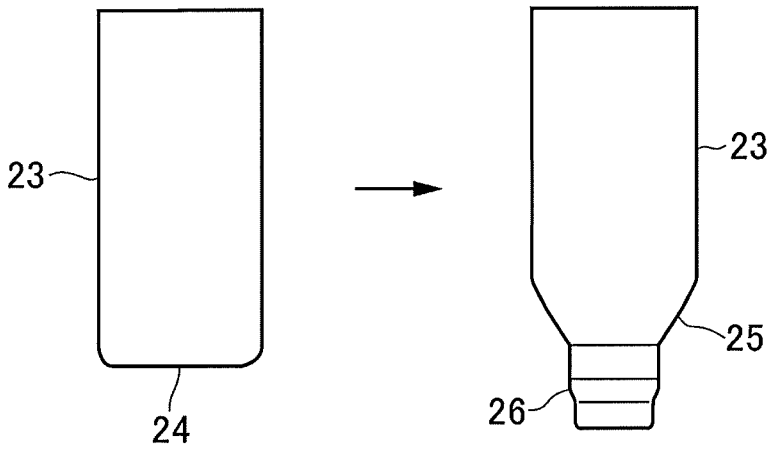
FIG. 4 is a schematic illustration showing a process of forming a shoulder portion and a diametrically-smaller cylindrical portion of the bottle-shaped can.
Figure 5:
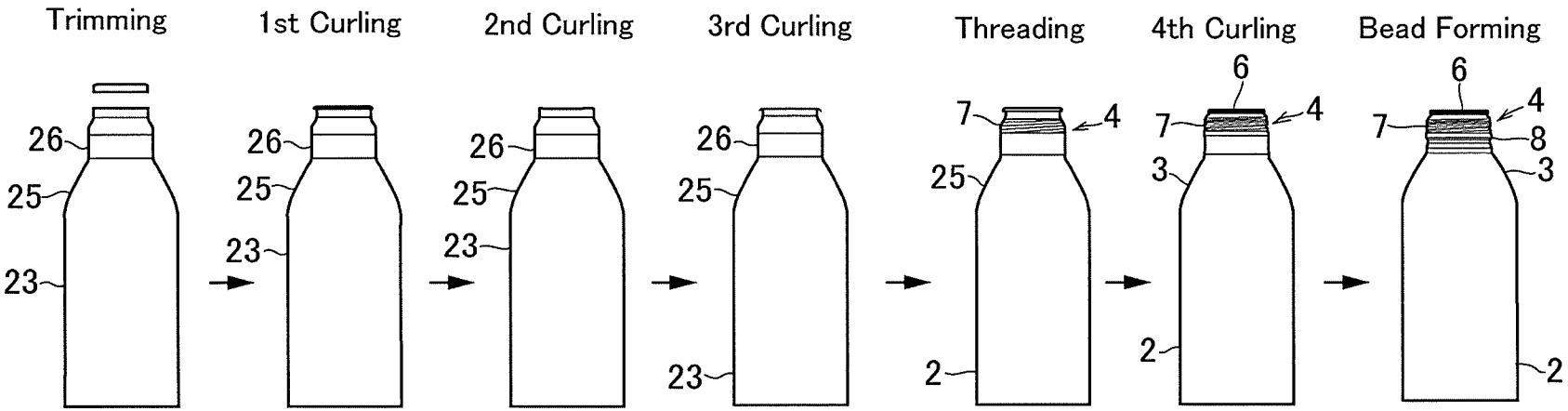
FIG. 5 is a process chart showing trimming, curling, threading and bead forming steps.

Here will be explained a manufacturing process of the bottle-shaped can 1. Turning to FIG. 3, there is shown a forming process of an intermediate product of the can trunk 2. First of all, a blank 21 is punched out of a thin metallic sheet material, and the blank 21 is drawn into a shallow cup 22. Thereafter, the cup 22 is shaped into a cylindrical body 23 by further applying a drawing and ironing to the cup 22. In this phase, as illustrated in FIG. 3, the cylindrical body 23 has a bottom 24. A center portion of the bottom 24 is further drawn and ironed to be gradually stretched while reducing a diameter of a circumferential corner of the bottom 24. As a result, as illustrated in FIGS. 4-5, a shoulder portion 25 and a diametrically-smaller cylindrical portion 26 are formed on a bottom side of the cylindrical body 23.

The diametrically-smaller cylindrical portion 26 is to be shaped into the neck portion 4, and for this purpose, the diametrically-smaller cylindrical portion 26 is further processed to have a capping function and a tamper-evidence function. A forming process of the neck portion 4 is shown in FIG. 5 in more detail. First of all, in order to form a container mouth on a leading end of the diametrically-smaller cylindrical portion 26, the leading end is cut out at a trimming step to be opened. In order to confine a sharp opening edge inside of the curled portion 6 having a round cross-section, the opening edge of the diametrically-smaller cylindrical portion 26 is folded outwardly into e.g., three layers. According to the example shown in FIG. 5, the curled portion 6 is formed by four curling steps. At the first curling step, the opening edge of the diametrically-smaller cylindrical portion 26 is bent outwardly to form a flange, and at the second curling step, the flange is further bent downwardly so that a folded portion of two layers is formed on the leading end of the diametrically-smaller cylindrical portion 26. Then, at the third curling step, the two-layered folded portion is bent outwardly so as to form a flange of two layers. Thereafter, at the fourth curling step, the two-layered flange thus formed is curled downwardly outwardly so that the opening edge of the diametrically-smaller cylindrical portion 26 is confined in the curled portion 6.

During the process of forming the curled portion 6, the thread ridge 7 is formed on the neck portion 4, and the emboss bead 8 is formed after the threading (e.g., after the final step of the curling) step to provide the tamper evidence function with the bottle-shaped can 1. In other words, the curling process is completed after the threading step, and then the bead forming step is executed.

Figures 6A, 6B, 6C:
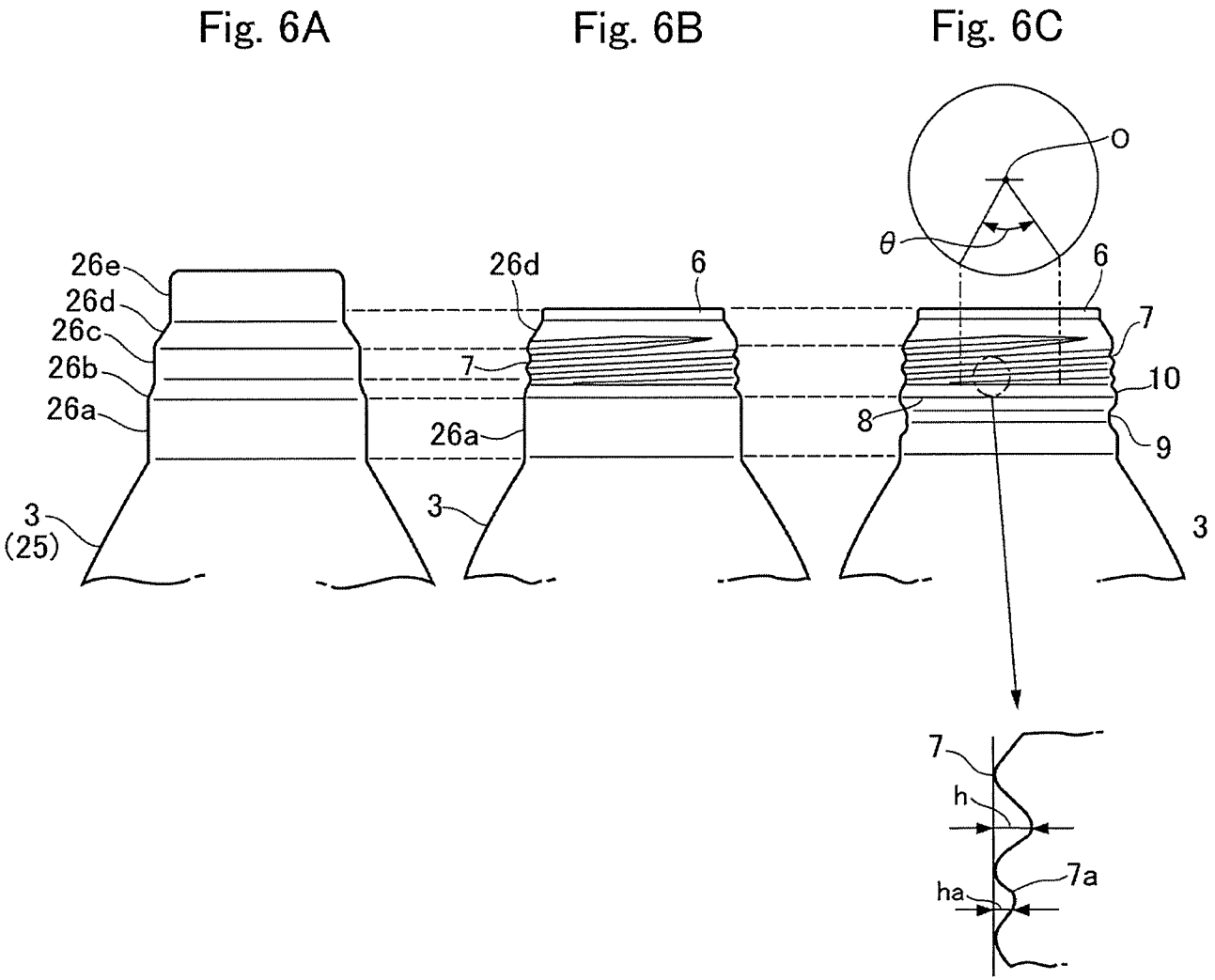

A change in the shape of the diametrically-smaller cylindrical portion 26 during the forming process of the neck portion 4 is shown in FIGS. 6A, 6B and 6C. FIG. 6A shows the diametrically-smaller cylindricall portion 26 before execution of the trimming step. In this phase, in the diametrically-smaller cylindrical portion 26, a cylindrical neck portion 26*a* extends continuously upwardly from the shoulder portion 3, and a diameter of the diametrically-smaller cylindrical portion 26 is reduced gradually in a diametrically shrinking portion 26*b* extending from the cylindrical neck portion 26*a*. A cylindrical threaded portion 26*c* is formed above the diametrically shrinking portion 26*b*, and the diameter of the diametrically-smaller cylindrical portion 26 is further reduced in a diametrically shrinking curved portion 26*d* extending from the cylindrical threaded portion 26*c*. A curled cylindrical portion 26*e* is formed above the diametrically shrinking curved portion 26*d*. In a case of forming the diametrically-smaller cylindrical portion 26 by drawing and ironing the bottom 24 of the cylindrical body 23, a thickness of the diametrically-smaller cylindrical portion 26 will be increased thicker than a thickness of the shoulder portion 3. Otherwise, in a case of forming the diametrically-smaller cylindrical portion 26 by shrinking a diameter of the opening end of the cylindrical body 23, a thickness of the diametrically-smaller cylindrical portion 26 will be identical to or increased thicker than a thickness of the shoulder portion 3.

The aforementioned stepped portion 10 is formed on the cylindrical neck portion 26*a* in which an outer diameter is largest in the diametrically-smaller cylindrical portion 26. As described, the outer diameter of the diametrically-smaller cylindrical portion 26 is reduced gradually in the diametrically shrinking portion 26*b* toward the cylindrical threaded portion 26*c*. The thread ridge 7 is formed on the cylindrical threaded portion 26*c*, and the outer diameter of the cylindrical threaded portion 26*c* is slightly smaller than the outer diameter of the cylindrical neck portion 26*a*. A width (or length) of the cylindrical threaded portion 26*c* in the axial direction is ensured sufficiently to form an effective thread portion of the thread ridge 7 thereon. The outer diameter of the diametrically-smaller cylindrical portion 26 is further reduced gradually in the diametrically shrinking curved portion 26*d* toward the curled cylindrical portion 26*e*. The curled cylindrical portion 26*e* is a cylindrical portion situated diametrically innermost side of the curled portion 7, and a diameter of the curled cylindrical portion 26*e* corresponds to an opening diameter of the bottle-shaped can 1.

FIG. 6B shows the neck portion 4 after the final curling step. In this phase, the leading end of the curled cylindrical portion 26*e* has been trimmed to be opened, and the opening edge of the curled cylindrical portion 26*e* has been curled outwardly to form the curled portion 6. Further, the thread ridge 7 has been formed below the curled portion 6 on the cylindrical threaded portion 26*c*. For example, the thread ridge 7 may be formed on the cylindrical threaded portion 26*c* using an inner tool having ridges and grooves formed alternately on an outer circumferential surface, and an outer tool having ridges and grooves to be engaged with the ridges and grooves of the inner tool (neither of which are shown). In this case, specifically, the thread ridge 7 as a helical ridge is formed on the cylindrical threaded portion 26*c* by sandwiching the cylindrical threaded portion 26*c* between the inner tool inserted loosely into the neck portion 4 in a rotatable and revolvable manner, and the outer tool disposed on outside of the neck portion 4 along a revolution orbit of the inner tool.

An incomplete thread portion 7*a* is formed at a starting end (or upper end) and a terminal end (or lower end) of the thread ridge 7 respectively. In the incomplete thread portion 7*a*, a height of the thread ridge (or a depth between the ridges) is shorter (or shallower) than an average height h of the thread ridge 7. In the thread ridge 7, at least a portion of the lower incomplete thread portion 7*a* is formed on the diametrically shrinking portion 26*b*. In the incomplete thread portion 7*a*, specifically, a height of the thread ridge varies linearly. A length of the incomplete thread portion 7*a* in the circumferential direction of the neck portion 4 is defined by a central angle θ between: a line drawn between a point at which a height of the thread ridge is one-half (½) of the average height h (e.g., a starting point) and a center point O of the neck portion 4; and a line drawn between a point at which a height of the thread ridge is one-quarter (¼) of the average height h (e.g., a terminal end) and a center point O of the neck portion 4. According to the exemplary embodiment, specifically, a length of the incomplete thread portion 7*a* is set in such a manner that the above-explained central angle θ becomes than 50 degrees or wider.

FIG. 6C shows the neck portion 4 after the bead forming step. For example, the stepped portion 10 may also be formed on the cylindrical neck portion 26*a* using an inner tool and an outer tool (neither of which are shown) individually having a forming surface for forming the stepped portion 10. Specifically, the stepped portion 10 may be formed on the cylindrical neck portion 26*a* by sandwiching a predetermined portion of the cylindrical neck portion 26*a* between the inner tool inserted loosely into the neck portion 4 in a rotatable and revolvable manner, and the outer tool disposed on outside of the neck portion 4 along a revolution orbit of the inner tool.

Figure 7:
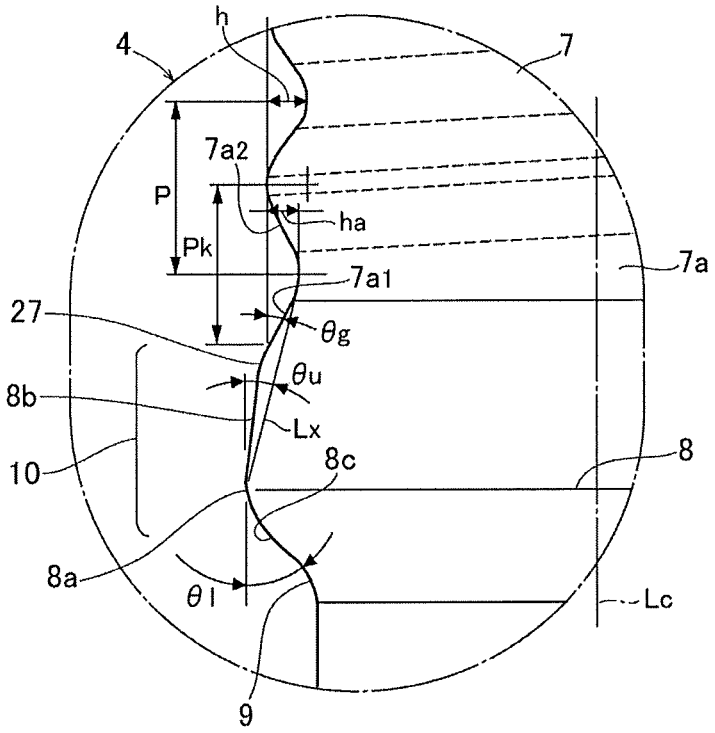
FIG. 7 is an enlarged view partially showing configurations of a stepped portion and an incomplete thread portion formed on the neck portion of the bottle-shaped can according to the exemplary embodiment of the present disclosure.
Figure 10:
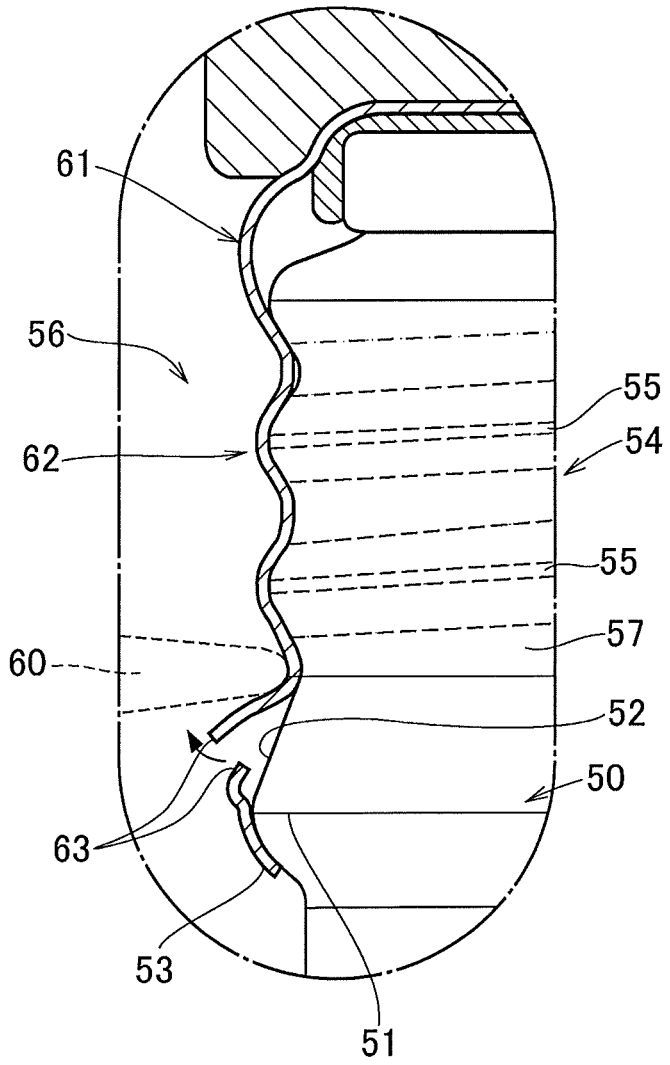
Fig. 10 PRIOR ART
FIG. 10 is an enlarged cross-sectional view showing a cross-section of a cap mounted on the neck portion of a conventional bottle-shaped can.

A configuration of the stepped portion 10 according to the exemplary embodiment is shown in FIG. 7. Specifically, FIG. 7 shows a shape of a portion of the stepped portion 10 connected to the lower incomplete thread portion 7*a*. As illustrated in FIG. 10, a boundary between the cylindrical neck portion 26*a* and the diametrically shrinking portion 26*b* is a diametrically largest portion 8*a* of the emboss bead 8. In the stepped portion 10, the annular groove 9 is formed underneath the diametrically largest portion 8*a* by pressing the neck portion 4 radially inwardly in such a manner that an outer diameter of the boundary between the cylindrical neck portion 26*a* and the diametrically shrinking portion 26*b* becomes largest in the neck portion 4. At the bead forming step, the annular groove 9 is formed mainly in such a manner as to maintain the outer diameter of the diametrically largest portion 8*a* to the outer diameter of the cylindrical neck portion 26*a*. Even if the diametrically largest portion 8*a* is expanded radially outwardly at the bead forming step, an amount of such expansion of the diametrically largest portion 8*a* is very small. Consequently, a portion of the tapered surface of the diametrically shrinking portion 26*b* remains in an upper inclined surface 8*b* formed above the diametrically largest portion 8*a* as a result of forming the annular groove 9. An angle of inclination θu of the upper inclined surface 8*b* (with respect to a center axis Lc of the neck portion 4: a half angle of a tapered angle) falls within a range from 2 degrees to 10 degrees. By contrast, an outer diameter of a lower inclined surface 8*c* as a tapered surface formed underneath the diametrically largest portion 8*a* as a result of forming the annular groove 9 reduces gradually toward the lower side. An angle of inclination θ1 of the lower inclined surface 8*c* (with respect to the center axis Lc: a half angle of a tapered angle) is wider than the angle of inclination θu of the upper inclined surface 8*b*. For example, the angle of inclination θ1 of the lower inclined surface 8*c* is approximately 45 degrees. Specifically, a surface of the diametrically largest portion 8*a* is curved smoothly in such a manner that a cross-section of the diametrically largest portion 8*a* in a plane including the center axis Lc of the neck portion 4 is curved into an arc of a predetermined radius.

At least a portion of the lower incomplete thread portion 7*a* is formed by pressing a portion of the diametrically shrinking portion 26*b* radially inwardly of the neck portion 4. Consequently, a portion of a tapered surface of the diametrically shrinking portion 26*b* is formed into a lower wall 7*a*1 of the lower incomplete thread portion 7*a*. An angle of inclination θg of the lower wall 7*a*1 (with respect to the center axis Lc) is wider than the angle of inclination θu of the diametrically shrinking portion 26*b* (or the upper inclined surface 8*b*). In other words, the lower wall 7*a*1 and an upper wall 7*a*2 of the incomplete thread portion 7*a* are inclined substantially symmetrical with each other in the vertical direction to open toward the radially outer side. Therefore, although a depth ha of a thread groove between the incomplete thread portion 7*a* and the emboss bead 8 is shallower than the average height h of the effective thread portion of the thread ridge, the thread groove can be formed sharply by the lower wall 7*a*1 and the upper wall 7*a*2. Consequently, a groove width Pk at an intermediate portion of the incomplete thread portion 7*a* in the length direction falls within a range from 0.9 times to 1.1 times of a pitch P of the thread ridge 7. Specifically, the groove width Pk is measured at a portion of the thread groove where a height of the incomplete thread portion 7*a* from a bottom of the thread groove is highest in the intermediate portion. In other words, the groove width Pk is measured at an outer diametrical position of a peak of the effective thread ridge. Here, a reason for the above-mentioned variation of the groove width Pk to be wider than or narrower than the pitch P of the thread ridge 7 seems to be a fact that the lower wall 7*a*1 is formed on the diametrically shrinking portion 26*b* at least partially.

Thus, the incomplete thread portion 7*a* is formed on the diametrically shrinking portion 26*b* at least partially, and the lower wall 7*a*1 of the incomplete thread portion 7*a* is formed by processing a portion of the upper inclined surface 8*b*. Therefore, the angle of inclination Og of the lower wall 7*a*1 with respect to the center axis Lc differs from the angle of inclination Ou of the upper inclined surface 8*b* with respect to the center axis Lc. For this reason, a protruding corner 27 is formed between the lower wall 7*a*1 and the upper inclined surface 8*b* to protrude radially outwardly with respect to the center axis Lc. Specifically, an outer diameter of the protruding corner 27 is smaller than the outer diameter of the diametrically largest portion 8*a* but larger than an outer diameter of the bottom of the thread groove of the incomplete thread portion 7*a* (or the thread ridge 7). In other words, a cross-sectional shape of the protruding corner 27 in a plane including the center axis Lc and vertically passing through the neck portion 4 protrudes radially outwardly from a line Lx drawn between the bottom of the thread groove of the incomplete thread portion 7*a* and a peak of the diametrically largest portion 8*a*.

Figure 8:
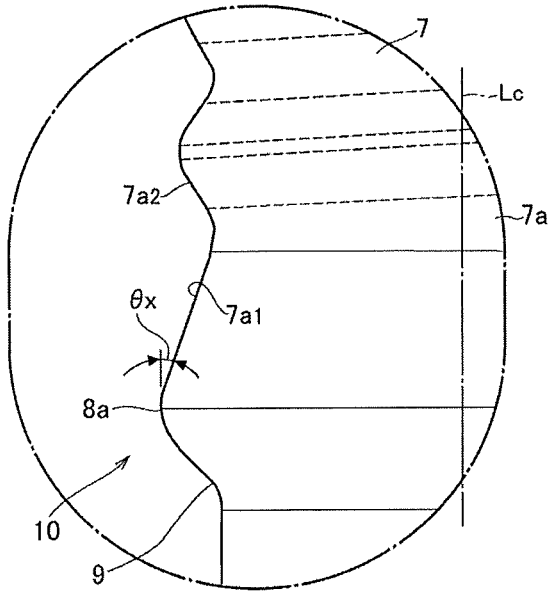
Fig. 8 PRIOR ART
FIG. 8 is an enlarged view partially showing a stepped portion and an incomplete thread portion formed on a neck portion of a conventional bottle-shaped can.

FIG. 8 shows configurations of the stepped portion and vicinity thereof in the conventional bottle-shaped can. In the conventional art, the incomplete thread portion 7*a* formed at least partially on the diametrically shrinking portion 26*b* is not subjected to any specific process. In other words, the incomplete thread portion 7*a* does not have any specific shape or configuration. Therefore, a cross section of the lower wall 7*a*1 of the incomplete thread portion 7*a* is joined linearly to the diametrically largest portion 8*a* and hence an angle of inclination θx of the lower wall 7*a*1 with respect to the center axis Lc is rather wide. That is, a shape of the lower wall 7*a*1 sags downwardly along the aforementioned line Lx. For this reason, the lower wall 7*a*1 and the upper wall 7*a*2 are formed asymmetrically and hence the thread groove is formed incompletely.

Figure 9:
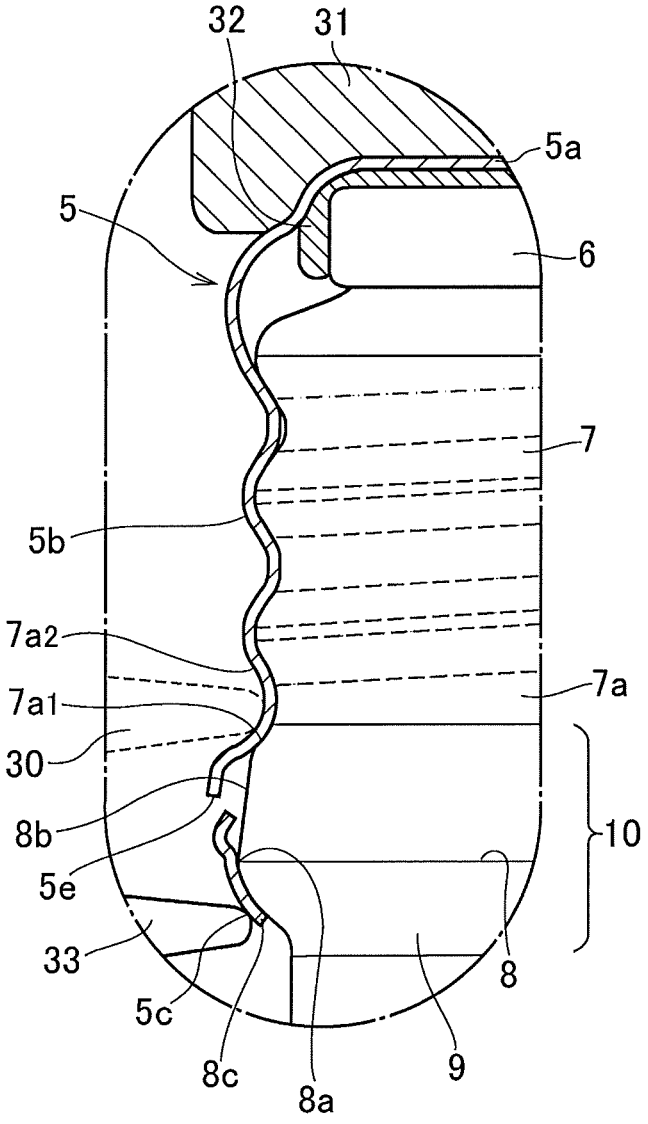
FIG. 9 is an enlarged cross-sectional view showing a cross-section of the cap mounted on the neck portion of the bottle-shaped can according to the exemplary embodiment of the present disclosure.

In the bottle-shaped can 1 according to the exemplary embodiment having the neck portion 4 thus has been described, a capping on the neck portion 4 is executed by the conventional procedures. A raw material of the cap 5 comprises a top panel, a cylindrical skirt portion, and a sealing liner 32 affixed to an inner surface of the top panel. The raw material of the cap 5 mounted on the neck portion 4 is processed to be engaged with the neck portion 4 through the thread. Turning to FIG. 9, there is shown a final phase of a thread forming on the cap 5. The skirt portion of the cap 5 is pressed radially inwardly onto the neck portion 4 by a thread roller 30 along the thread ridge 7 so that the helical groove (or ridge) to be engaged with the thread ridge 7. Consequently, the thread groove is also formed at each upper end and lower end of the helical groove of the cap 5 along the upper incomplete thread portion 7*a* and the lower incomplete thread portion 7*a* of the thread ridge 7. As described, the circumferential corner of the top panel 5*a* is swaged by a pressure block 31 to bring the sealing liner 32 into close contact to the curled portion 6. That is, the thread forming on the skirt portion 5*b* is executed while pushing the cap 5 onto the neck portion 4 by the pressure block 31. A lower end portion of the pilfer-proof band 5*c* is swaged by a swaging roller 33 to be brought into close contact to the lower inclined surface 8*c* of the stepped portion 10. In the cap 5 thus mounted on the neck portion 4, the slits 5*e* and the bridges 5*f* are situated at a level lower than the protruding corner 27 to be opposed to the upper inclined surface 8*b*.

As described, a depth of the lower incomplete thread portion 7*a* decreases gradually. However, the lower wall 7*a*1 and an upper wall 7*a*2 of the lower incomplete thread portion 7*a* are symmetrical with each other with respect to the protruding corner 27. Therefore, in the groove between the lower wall 7*a*1 and an upper wall 7*a*2, the thread roller 30 receives reaction forces equally from the lower wall 7*a*1 and an upper wall 7*a*2. For this reason, the thread roller 30 is allowed to form the thread groove on the skirt portion 5*b* without causing an interference with the slits 5*e* and the bridges 5*f*. In other words, the thread groove may be formed on the skirt portion 5*b* without damaging the slits 5*e* and the bridges 5*f*. In addition, the lower wall 7*a*1 and an upper wall 7*a*2 equally receives a load to form the thread groove on the skirt portion 5*b* along the lower incomplete thread portion 7*a*. Therefore, the slits 5*e* and the bridges 5*f* may be prevented from being subjected to an excessive stress when forming the thread groove on the skirt portion 5*b*. For this reason, the thread groove may be formed on the skirt portion 5*b* without turning or curling a lower portion of the skirt portion 5*b* above the slits 5*e* and without rupturing the bridges 5*f*. Further, in the bottle-shaped can 1 according to the exemplary embodiment, it is not necessary to isolate the stepped portion 10 and the thread ridge 7 from each other in the axial direction of the neck portion 4 to limit damages on the slits 5*e* and the bridges 5*f*. For this reason, a total length of the neck portion 4 may be shortened to reduce the material of the bottle-shaped can 1.

Although the above exemplary embodiments of the present disclosure have been described, it will be understood by those skilled in the art that the present disclosure should not be limited to the described exemplary embodiments, and various changes and modifications can be made within the scope of the present disclosure.

What is claimed is:

1. A bottle-shaped can, comprising:

a neck portion in which an upper end portion is opened; and a cap that is mounted on the neck portion to close the upper end portion of the neck portion, wherein a thread ridge is formed on the neck portion to engage the cap with the neck portion, and an annular bead is formed on the neck portion below the thread ridge, the cap comprises a band portion formed around the annular bead to be engaged with the annular bead, and a plurality of slits and bridges formed alternately in a circumferential direction of the cap, the band portion is detached from the cap by rupturing the bridges, the annular bead comprises a diametrically largest portion, an upper inclined surface extending upwardly from the diametrically largest portion in which an outer diameter of the neck portion gradually decreases, and a lower inclined surface extending downwardly from the diametrically largest portion in which the outer diameter of the neck portion gradually decreases, an angle of inclination of the upper inclined surface with respect to a center axis of the neck portion is narrower than an angle of inclination of the lower inclined surface with respect to the center axis of the neck portion, the thread ridge comprises an incomplete thread portion in which a groove depth is shallower than an average groove depth of the thread ridge, the incomplete thread portion is formed at one end of the thread ridge on the upper inclined surface of the annular bead at least partially, an angle of inclination of a lower wall of a groove of the thread ridge with respect to the center axis is greater than the angle of inclination of the upper inclined surface with respect to the center axis so that a protruding corner is formed between the lower wall and the upper inclined surface to protrude radially outwardly, and the slits and the bridges are situated at a level lower than the protruding corner in the cap mounted on the neck portion.

2. The bottle-shaped can as claimed in claim 1, wherein a length of the incomplete thread portion in the circumferential direction of the neck portion is defined by an angle between: a line drawn between a terminal end of the incomplete thread portion and a center point of the neck portion; and a line drawn between a starting point of the incomplete thread portion, and the length of the incomplete thread portion in the circumferential direction of the neck portion is set such that said angle is 50 degrees or wider.

3. The bottle-shaped can as claimed in claim 1, wherein an outer diameter of the protruding corner is smaller than a maximum diameter of the annular bead, and wherein the outer diameter of the protruding corner is larger than an outer diameter of a bottom of the groove of the incomplete thread portion.

4. The bottle-shaped can as claimed in claim 2, wherein an outer diameter of the protruding corner is smaller than a maximum diameter of the annular bead, and wherein the outer diameter of the protruding corner is but larger than an outer diameter of a bottom of the groove of the incomplete thread portion.

5. The bottle-shaped can as claimed in claim 1, wherein an outer diameter of the protruding corner is smaller than a maximum diameter of the annular bead, and wherein the outer diameter of the protruding corner is larger than an outer diameter of the thread ridge.

6. The bottle-shaped can as claimed in claim 2, wherein an outer diameter of the protruding corner is smaller than a maximum diameter of the annular bead, and wherein the outer diameter of the protruding corner is but larger than an outer diameter of the thread ridge.

7. The bottle-shaped can as claimed in claim 3, wherein the outer diameter of the protruding corner is smaller than the maximum diameter of the annular bead, and wherein the outer diameter of the protruding corner is larger than an outer diameter of the thread ridge.

8. The bottle-shaped can as claimed in claim 4, wherein the outer diameter of the protruding corner is smaller than the maximum diameter of the annular bead, and wherein the outer diameter of the protruding corner is larger than an outer diameter of the thread ridge.

* * * * *